US006644750B1

(12) United States Patent
Sandman et al.

(10) Patent No.: US 6,644,750 B1
(45) Date of Patent: Nov. 11, 2003

(54) BENCH HAVING A REMOVABLE BACK SECTION

(75) Inventors: Paul E. Sandman, Louisville, KY (US); John R. Meek, Louisville, KY (US)

(73) Assignee: Oxford Limited, Inc., Louisville, KY (US)

( * ) Notice: Subject to any disclaimer, the term of this patent is extended or adjusted under 35 U.S.C. 154(b) by 18 days.

(21) Appl. No.: 10/052,871

(22) Filed: Oct. 29, 2001

(51) Int. Cl.[7] ..... A47C 7/00

(52) U.S. Cl. ..... 297/440.21; 297/217.1; 297/230.1; 297/452.63

(58) Field of Search ..... 297/452.63, 217.1, 297/440.21, 230.1, 230.12, 230.13, 230.14, 232; 182/33, 35; 40/320, 727

(56) References Cited

U.S. PATENT DOCUMENTS

| | | | | | |
|---|---|---|---|---|---|
| 192,770 | A | * | 7/1877 | Lacomme et al. | 40/320 |
| 684,403 | A | * | 10/1901 | Bendict | 297/87 |
| 1,222,089 | A | | 4/1917 | Ferry | |
| 1,395,153 | A | | 10/1921 | Schomacher | |
| 1,773,752 | A | * | 8/1930 | Ross | 297/276 |
| 1,786,123 | A | | 12/1930 | Murphy | |
| 2,118,676 | A | * | 5/1938 | Lankton | 297/302.4 |
| 2,659,422 | A | | 11/1953 | Holland | |
| 2,711,786 | A | | 6/1955 | Weiss | |
| 3,175,269 | A | * | 3/1965 | Raduns | 24/265 C |
| 3,283,433 | A | | 11/1966 | Navarino | |
| 4,828,320 | A | * | 5/1989 | Saiger | 297/229 |
| 5,329,716 | A | | 7/1994 | Fite | |
| 5,356,204 | A | | 10/1994 | McDonough | |
| 5,407,250 | A | * | 4/1995 | Prince et al. | 297/440.2 |
| 5,683,137 | A | | 11/1997 | McDonald et al. | |
| 5,862,616 | A | | 1/1999 | Peroni | |

* cited by examiner

*Primary Examiner*—Peter M. Cuomo
*Assistant Examiner*—Erika Garrett
(74) *Attorney, Agent, or Firm*—Charles G. Lamb; Middleton Reutlinger

(57) ABSTRACT

A bench having a back section and a seating section includes a plurality of vertically extending back members attached at opposed ends to an upper horizontal back support member and a lower horizontal longitudinally extending lower back support member wherein one of the vertically extending back members is removable received by said upper and said lower longitudinally extending back support members. The removable vertically extending back member is generally wider than the attached vertically extending support members and includes printing indicia thereon.

7 Claims, 1 Drawing Sheet

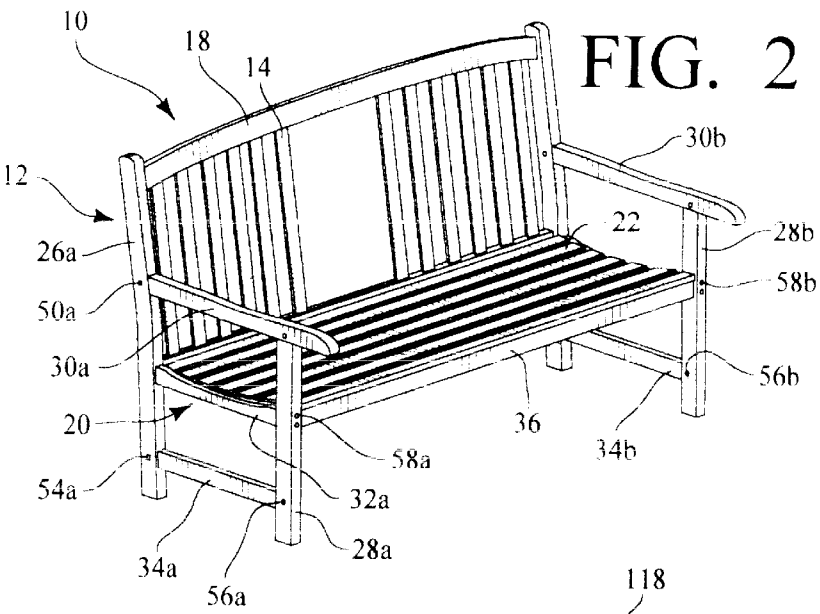
FIG. 1
FIG. 2
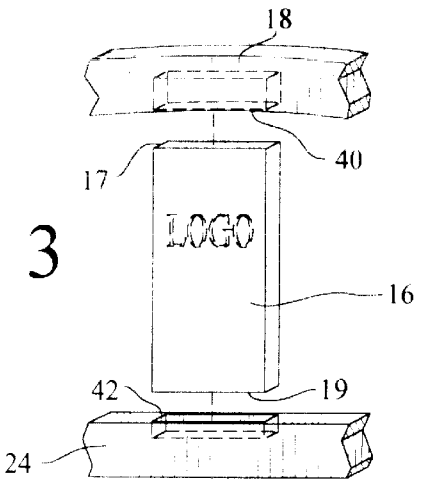
FIG. 3
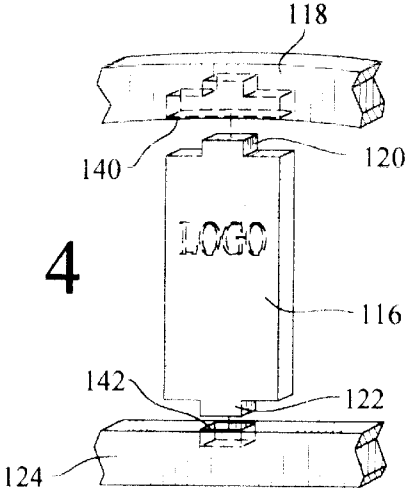
FIG. 4

BENCH HAVING A REMOVABLE BACK SECTION

BACKGROUND OF THE INVENTION

The present invention relates to a bench having a removable back section and more particularly to a bench having a removable back section for placing advertising indicia, or the like thereon.

It is commonplace in international trade to have products manufactured in sections in one country and then shipped for assembly and distribution in another country. In regards to the manufacture and sale of bench products made from hard woods and the like, it is common to have the country of origin of the hard woods to assemble the benches in sections so that all of the sections of the bench may be packaged in relatively small, flat packages for shipment to the United States or other countries where the sections of the disassembled bench products are then assembled into a bench product. For example, in the manufacturing and sales of bench products made from wood, it is commonplace for the back section to be assembled into one section, the seating section to be made in a separate section, and the supports for connecting the back section to the seating section are individually constructed and placed with the back and seat sections for shipment. More particularly, in the manufacture of benches the back section generally includes an upper horizontal support member and a lower horizontal support member with a plurality of vertically extending support members attached to the upper and lower horizontally extending support members. These vertically extending members are generally fixedly attached to the upper and lower horizontal members. It is also commonplace in the use of outside benches at shopping centers, parks, bus stops and the like, to place advertising indicia upon the benches to promote other products and services. However, in the use of a bench which has fixedly attached vertically extending back members which are fixedly attached in the country or origin, this restricts the use of promotional indicia on the back members as it is generally difficult to place printing indicia thereon once the back members are fixed in place in the back section.

SUMMARY OF THE INVENTION

It is an object of the present invention to provide a bench which includes a back section which is conducive for placing promotional indicia thereon.

It is another object of the present invention to provide a bench having a back section with a removable vertically extending back member wherein the removable back member is used to receive promotional indicia thereon.

It is a further object of the present invention to provide a bench having a back section with a removable vertically extending back section which is centrally disposed of the back section.

It is also an object of the present invention to provide a bench which is easily assembled from preassembled back and seating sections.

More particularly, the present invention is directed to a bench comprised of a back section and a seating section. The back section includes a longitudinally extending upper horizontal support member and a longitudinally extending lower support member with at least one removable vertically extending back member removable attached to the upper support member and the lower support member. A seating section is attached to the back section at the lower support member.

A more comprehensive understanding of the present invention may be obtained by considering the following figures and the detailed description of the preferred embodiments thereof.

BRIEF DESCRIPTION OF THE DRAWINGS

FIG. 1 is a perspective view of the bench of the present invention;

FIG. 2 is a perspective view of the bench of the present invention including a removable back member removed from the back section of the bench.

FIG. 3 is an enlarged exploded view of a removable back member of FIG. 1;

FIG. 4 is an exploded view of another preferred removable back member of the present invention.

DETAILED DESCRIPTION OF THE PREFERRED EMBODIMENTS

As shown in FIGS. 1 and 2, a bench 10 of the present invention is shown with a back section 12 which is attached to a seating section 20. The back section 12 is comprised of an upper horizontally extending back support member 18 and a lower horizontal back support member 24 with a plurality of vertically extending back members 14 evenly spaced along and attached to the upper support member 18 and the lower support member 24. In the central portion of the back section 12 is a removable vertically extending back member 16 which is removably received by the upper and lower support members 18 and 20, respectively. As shown in FIG. 3, the removable back support member 16 is provided with an upper end 17 and a lower end 19 and the upper horizontal support member 18 is provided with a slot 40 therein to receive the upper end 17 of the vertically back member 16. The lower horizontal back support member 24 is provided with a slot 42 therein to receive the lower end 19 of the back member 16. It is noted that the slot 40 has a depth sufficient to receive end 17 so that end 19 passes over the member 24 before receipt by slot 42. Moreover, slot 42 has a depth substantially less than slot 40 so the back member 16 is held securely within slots 40, 42. Furthermore, back member 16 is generally wider than back members 14 as back member 16 is removable to receive promotional indicia thereon.

Referring back to FIGS. 1 and 2, the seating section 20 includes a plurality of longitudinally extending spaced seat members 22 disposed in parallel from the back to the front of the seating section 20. The back of the seating section 20 includes the lower horizontal back support member 24 and the front of the seating section 20 includes a front longitudinally extending horizontal support member 36.

On each side of the bench 10 is a pair of legs 26*a* and 28*a* on one side, and legs 26*b* and 28*b* on the opposite side. Legs 26*a*, 26*b* are the back support legs and legs 28*a*, 28*b* are the front support legs. Legs 26*a* and 28*a* are attached to each other by an upper transversely extending arm 30*a*, a middle horizontal support transverse member 32*a*, and a lower transverse horizontally extending support member 34*a*. The legs 26*a* and 28*a* are attached to the horizontally extending transverse members 30*a*, 32*a* and 34*a* by elongated pins 50*a*, 52*a*, 54*a*, 56*a* and 58*a*. On the opposed side the back leg 26*b* is attached to the front leg 28*b* by the transversely extending arm member 30*b*, a transversely extending middle support member (not shown), and a lower transversely extending member 34*b*. As shown in the Figs., pins 50*b*, 52*b*, 56*b* and 58*b*, are used to attach the transversely extending members to the legs members. It is realized that even though pin members are shown as attaching the transversely extending support members to the leg members, tongue and groove type fittings may also be used without departing from the scope and spirit of the present invention. Moreover, adhesively securing or other means may be used to attach the transversely extending support members to the leg members.

The leg members 26*a* and 26*b* are attached to the upper horizontal back support member 18 and the lower horizontal back member 24. The seat members 22 are attached to the transversely extending mid-section horizontal members 32*a* and 33*b*. Moreover, as shown, the front longitudinal horizontal support member is also attached to the front legs 28*a* and 28*b*.

In the manufacture of the bench of FIGS. 1 and 2, the back section, including the upper and lower support members 18 and 24, with the vertically extending back members 14 and 16 are preassembled in one section. The seat section 20, including the horizontal seat members 22, the front longitudinally extending horizontal support member 36, and the transversely extending middle horizontal support members 32*a* and 32*b* are preassembled in a seating section. The front and back legs 26*a*, 26*b* and 28*a*, 28*b*, respectively, arms 30*a*, 30*b*, and lower transversely extending support members 34*a* and 34*b* are either assembled as a unit or shipped in individual pieces. Thus, upon receipt of the bench sections, the bench is easily assembled by assembling the support members to the back section 12 and the seating section 20.

As shown in FIG. 4, a second preferred removable vertically extending back member, identified by the numeral 116, is shown with an upper tongue 120 and a lower tongue 122 for receipt by groove 140 in an upper horizontal back support member 118 and a lower groove 142 in a lower horizontally extending back support member 124. The tongue 120 is of greater length than the tongue 122 and the groove 140 is of greater depth than groove 142 so that upon insertion and removal of back member 116, tongue 120 is inserted into groove 140 a sufficient depth to facilitate tongue 122 passing over number 124 for receipt into groove 142. As groove 140 has a depth greater than groove 142, upon receipt of the tongues into the grooves, removable back is held securely in place.

In the preferred embodiments, the materials for use in the bench are generally hard woods, such as, for example, teak, belau, bangkirai, mahogany.

It will be realized that various changes may be made to the specific embodiments shown and described without departing from the principals and spirit of the present invention as set forth in the claims appended hereto.

What is claimed is:

1. A bench comprising:

a back section, said back section having a longitudinally extending upper horizontal back support member and a lower longitudinally extending back support member, said back section having at least one removable vertically extending back member having a first end received by a first slot in said upper horizontal back support member and an opposed second end received by a second slot in said lower horizontal back support member, said first slot having a depth greater than said second slot;

a horizontally extending seating section extending outwardly from said lower horizontal back support member;

a back vertically extending leg support member on each side of said back and said seat sections and attached thereto;

a front vertically extending leg support member on each side of said seat section and attached thereto;

at least one horizontally transversely extending member on each side of said seat section connecting said back and said front vertically extending leg support member.

2. The bench of claim 1, said back section including a plurality of spaced vertically extending back members attached to said upper and lower vertical back members.

3. The bench of claim 2, said removable back member being wider than said vertically extending attached back members, said removable back member being centrally disposed of said back section.

4. The bench of claim 1, said removable back member having indicia thereon.

5. The bench of claim 1, said removable back member having a tongue at at least one of said first and said second ends, at least one of said first and said second slots of said upper and said lower horizontally extending back support members being a groove therein to receive said tongue of said removable back member.

6. The bench of claim 1, including a pair of arms on each side of said seat section, said arms being attached to said back legs and said front legs.

7. The bench of claim 1, the back section and the seat section being removably attached to said vertically extending leg supports.

* * * * *